US011304584B2

(12) United States Patent
Krebs et al.

(10) Patent No.: US 11,304,584 B2
(45) Date of Patent: Apr. 19, 2022

(54) SURFACE CLEANING APPARATUS

(71) Applicant: BISSELL Inc., Grand Rapids, MI (US)

(72) Inventors: Alan J. Krebs, Pierson, MI (US); Ming Luo, Shenzhen (CN); Jin Yang, Shenzhen (CN)

(73) Assignee: BISSELL Inc., Grand Rapids, MI (US)

( * ) Notice: Subject to any disclaimer, the term of this patent is extended or adjusted under 35 U.S.C. 154(b) by 321 days.

(21) Appl. No.: 16/555,037

(22) Filed: Aug. 29, 2019

(65) Prior Publication Data

US 2019/0380557 A1 Dec. 19, 2019

Related U.S. Application Data

(63) Continuation of application No. 15/435,958, filed on Feb. 17, 2017, now Pat. No. 10,398,280.
(Continued)

(51) Int. Cl.
*A47L 13/22* (2006.01)
*A47L 13/254* (2006.01)
(Continued)

(52) U.S. Cl.
CPC ..... *A47L 13/225* (2013.01); *A47L 11/26* (2013.01); *A47L 11/4083* (2013.01);
(Continued)

(58) Field of Classification Search
CPC .. A47L 11/26; A47L 11/4083; A47L 11/4086; A47L 13/225; A47L 13/254;
(Continued)

(56) References Cited

U.S. PATENT DOCUMENTS 6,511,548 B1 * 1/2003 Oreck ..... A47L 7/04 134/21
8,069,520 B2 * 12/2011 Mattucci ..... A46B 13/02 15/4

(Continued)

FOREIGN PATENT DOCUMENTS

EP 1980192 A2 10/2008
KR 20010109815 A * 12/2001

(Continued)

OTHER PUBLICATIONS

Shark S4601 Owner's Guide, 40 pages, www.sharkclean.com; http://www.sharkclean.com/include/pdf/manual-S4601.pdf; item access Feb. 17, 2017.

(Continued)

*Primary Examiner* — Marc Carlson
(74) *Attorney, Agent, or Firm* — McGarry Bair PC

(57) ABSTRACT

A surface cleaning apparatus, such as a steam mop, includes a steam delivery system having a steam delivery pathway. A fragrance dispenser for receiving a fragrant material is provided on the apparatus, and a portion of the steam delivery pathway is in heat exchange relationship with the fragrance dispenser to heat the fragrant material in the fragrance dispenser by heat transfer from the steam in the pathway. Fragrance is dispensed from apparatus via heat transfer utilizing the steam pathway as a thermal radiation source.

20 Claims, 10 Drawing Sheets

Related U.S. Application Data

(60) Provisional application No. 62/296,213, filed on Feb. 17, 2016.

(51) Int. Cl.
*B08B 3/10* (2006.01)
*A47L 11/40* (2006.01)
*A47L 11/26* (2006.01)

(52) U.S. Cl.
CPC ..... *A47L 11/4086* (2013.01); *A47L 13/254* (2013.01); *B08B 3/106* (2013.01); *A47L 2601/04* (2013.01); *A47L 2601/20* (2013.01); *B08B 2230/01* (2013.01)

(58) Field of Classification Search
CPC ..... A47L 2601/04; A47L 2601/20; B08B 2230/01; B08B 3/106
See application file for complete search history.

(56) References Cited

U.S. PATENT DOCUMENTS 8,927,480 B2 * 1/2015 Williams ..... C11D 17/0039 510/295
2007/0079470 A1 * 4/2007 Rippl ..... A47L 11/405 15/320
2007/0145191 A1 6/2007 Smith et al.
2010/0186463 A1 * 7/2010 Vrdoljak ..... A47L 13/256 68/222
2012/0145189 A1 * 6/2012 Knopow ..... F24V 30/00 134/6
2012/0145191 A1 * 6/2012 Williams ..... A47L 13/17 134/6
2013/0232719 A1 * 9/2013 Luedke ..... A47L 13/42 15/320
2014/0331443 A1 * 11/2014 Houghton ..... A47L 11/34 15/320
2015/0082566 A1 * 3/2015 Davidshofer ..... A47L 13/42 15/118
2015/0089757 A1 * 4/2015 Davidshofer ..... A47L 13/254 15/147.2
2015/0201820 A1 * 7/2015 Escobar ..... A47L 13/254 15/118
2016/0374533 A1 * 12/2016 Innes ..... A47L 13/26 15/319
2017/0127903 A1 * 5/2017 Grandstrand ..... A47L 11/4086
2017/0231455 A1 * 8/2017 Krebs ..... A47L 13/225 15/320
2019/0380557 A1 * 12/2019 Krebs ..... A47L 13/225

FOREIGN PATENT DOCUMENTS

KR 20010109815 A 12/2001
KR 20140111819 A * 9/2014
KR 1020140111819 A 9/2014
WO WO-2010078513 A1 * 7/2010 ..... A47L 13/256
WO WO-2011019814 A2 * 2/2011 ..... A47L 13/225
WO 2015067920 A1 5/2015
WO WO-2016191767 A2 * 12/2016 ..... A47L 13/12

OTHER PUBLICATIONS

Rhodri Evans, Search Report Under Section 17(5), 3 pages, dated Jun. 13, 2017, South Wales.

* cited by examiner

SURFACE CLEANING APPARATUS

CROSS-REFERENCE TO RELATED APPLICATION(S)

This application is a continuation of U.S. patent application Ser. No. 15/435,958, filed Feb. 17, 2017, now U.S. Pat. No. 10,398,280, issued Sep. 3, 2019, which claims the benefit of U.S. Provisional Patent Application No. 62/296,213, filed Feb. 17, 2016, all of which are incorporated herein by reference in their entirety.

BACKGROUND

Steam mops are well known devices for cleaning bare floor surfaces, such as tile, linoleum, vinyl, laminate, and hardwood floors. Typical steam mops have a reservoir for storing water that is fluidly connected to a selectively engageable pump or valve. The pump or valve outlet is fluidly connected to a steam generator to heat the water. The steam generator generates steam, which is directed towards the cleaning surface through a nozzle or manifold mounted in the foot. Steam is typically applied to the backside of a mop pad or cloth attached to the foot. Steam vapor eventually saturates the entire pad as the moisture wicks outwardly from the point of steam application. The damp pad is wiped across the surface to be cleaned to remove dirt, dust, and debris present on the cleaning surface.

BRIEF SUMMARY

In one aspect, the present disclosure relates to a surface cleaning apparatus, including a handle assembly, a steam delivery system, having a supply tank provided on the handle assembly, the supply tank configured for receiving and storing a cleaning fluid, a steam generator provided on the handle assembly, the steam generator fluidly coupled with the supply tank and comprising a heating element configured to heat liquid to at least 100° C. to generate steam, and a steam outlet located on the handle assembly, a base selectively operably coupled with the handle assembly, the base including a steam distributor fluidly coupled with the steam outlet when the base is operably coupled to the handle assembly, the steam distributor adapted for delivering steam to the surface to be cleaned, and an agitator operably coupled with the handle assembly adjacent the steam outlet.

In another aspect the present disclosure relates to a surface cleaning apparatus including a supply tank for receiving and storing a cleaning fluid located on a handle assembly, a steam generator fluidly coupled with the supply tank and comprising a heating element configured to heat liquid to at least 100° C. to generate steam, a steam outlet for delivering steam from the handle assembly, an agitator located adjacent the steam outlet, and a removable cleaning head selectively operably coupled to the handle assembly and forming a foot wherein the surface cleaning apparatus can be utilized in a first cleaning configuration that is an upright mode with the foot against the surface to be cleaned and wherein removal of the removable cleaning head allows a second cleaning configuration utilizing the agitator against the surface to be cleaned.

DETAILED DESCRIPTION

The present disclosure generally relates to features and improvement for a surface cleaning apparatus, such as an apparatus with steam delivery or a steam mop.

Examples of a suitable surface cleaning apparatus in which the various features and improvements described herein can be used are disclosed in U.S. Pat. No. 8,927,480, issued Jan. 6, 2015 and U.S. Patent Application Publication No. 2013/0232719, published Sep. 12, 2013, which are incorporated herein by reference in their entirety. Aspects of the present disclosure may also be incorporated into non-steam apparatus, such as surface cleaning apparatus with liquid delivery.

Figure 1:
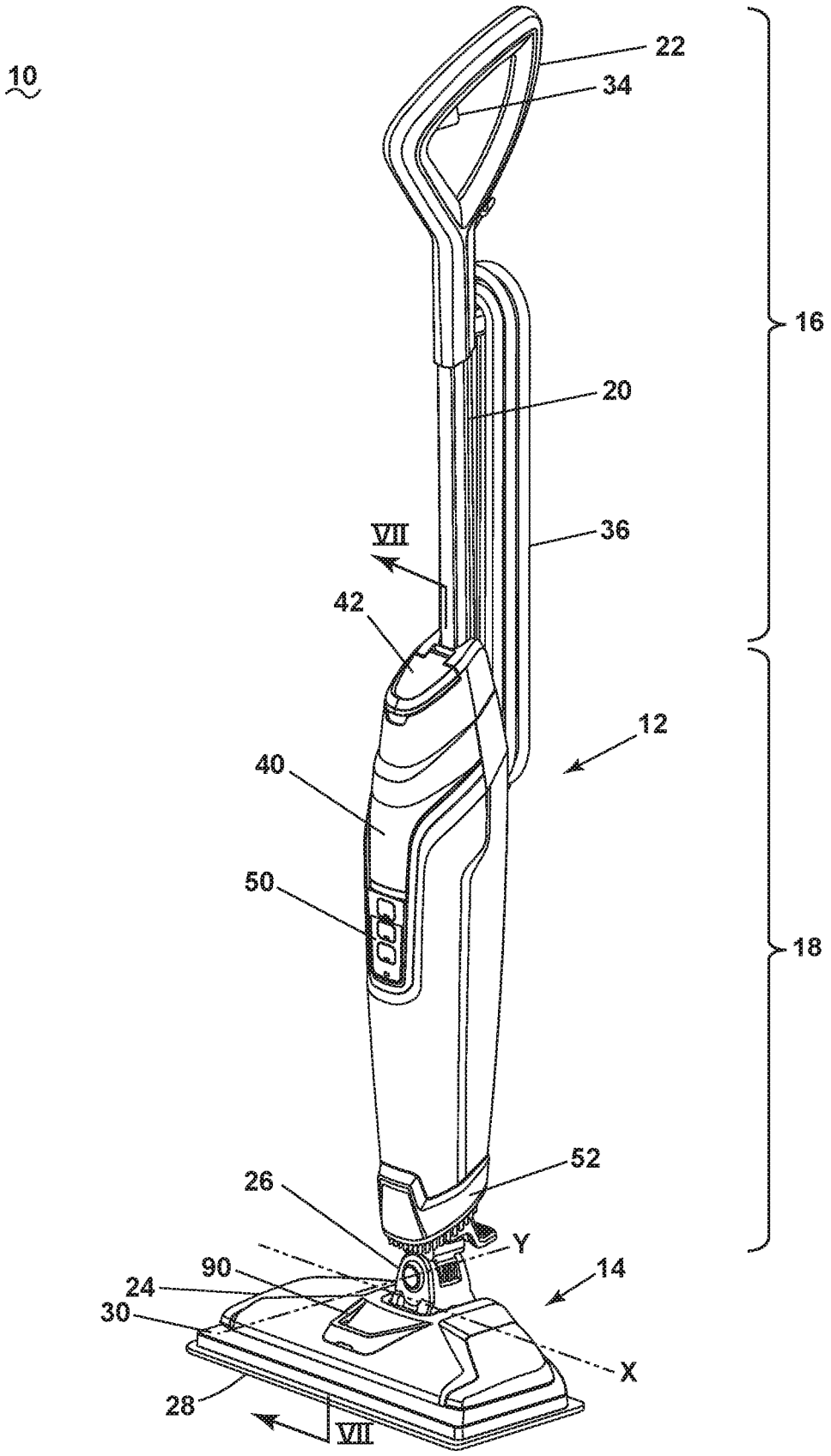
FIG. 1 is a perspective view of a surface cleaning apparatus in the form of a steam mop according to one example of the present disclosure.

FIG. 1 is a perspective view of a surface cleaning apparatus in the form of a steam mop 10 according to one example of the present disclosure. The steam mop 10 can include an upright handle assembly 12 and a base or foot 14 coupled with the handle assembly 12. The handle assembly 12 can be pivotally mounted to the foot 14 for movement from an upright or vertical position, where the handle assembly 12 is substantially vertical relative to a surface to be cleaned, to a lowered position, whereby the handle assembly 12 is rotated in a rearward direction relative to the foot 14 to an acute angled relative to the surface to be cleaned. The steam mop 10 is adapted to glide across the floor or other hard surface on the foot 14.

For purposes of description related to the figures, the terms "upper," "lower," "right," "left," "rear," "front," "vertical," "horizontal," "inner," "outer," and derivatives thereof shall relate to the present disclosure as oriented in FIG. 1 from the perspective of a user behind the steam mop 10, which defines a rear of the mop. However, it is to be understood that the present disclosure may assume various alternative orientations, except where expressly specified to the contrary.

The handle assembly 12 can include an upper handle assembly 16 and a lower handle assembly 18. The upper handle assembly 16 comprises a hollow handle tube 20 having a grip assembly 22 coupled with a first end of the handle tube 20 and the lower handle assembly 18 coupled with a second end of the handle tube 20.

The foot 14 can include a cleaning head 24 having a coupling joint 26 which couples the cleaning head 24 to the lower handle assembly 18. The coupling joint 26 can be a universal joint or swivel joint with permits the foot 14 to swivel about multiple axes X, Y relative to the lower handle assembly 18. In other examples, the coupling joint 26 may be a single axis joint permitting the foot 14 to rotate about axis X. A cleaning cloth or pad 28 through which steam and/or a cleaning fluid is dispensed onto a surface to be cleaned is coupled to a bottom of the cleaning head 24. The cleaning pad 28 can be removably coupled with the cleaning head 24 according to any known method. The cleaning head 24 can include a support for the cleaning pad 28, such as a pad mounting plate 30, provided on the bottom side of the cleaning head 24. The cleaning pad 28 can be configured to be disposable after one or more uses, or can be washable for reuse. In one example, the pad 28 is a reusable microfiber fabric.

Figure 2:
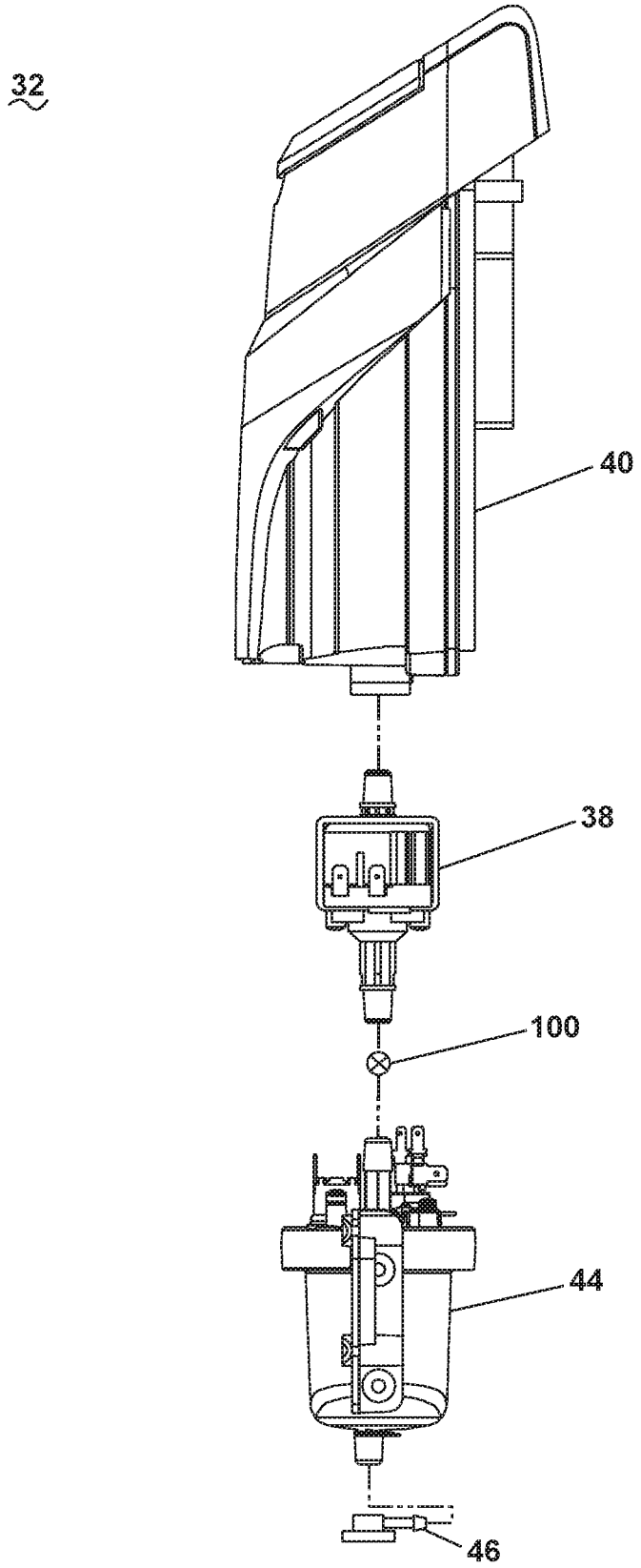
FIG. 2 is a schematic view of a fluid distribution system of the steam mop from FIG. 1.

FIG. 2 is a schematic view of a fluid distribution system 32 of the steam mop 10. The fluid distribution system 32 can be primarily located within the lower handle assembly 18, although it is also within the scope of the present disclosure for all or a portion of the fluid distribution system 32 to be located within the foot 14. The fluid distribution system 32 illustrated herein is more specifically a steam delivery system which generates steam from liquid and delivers the steam to a surface to be cleaned.

Figure 7:
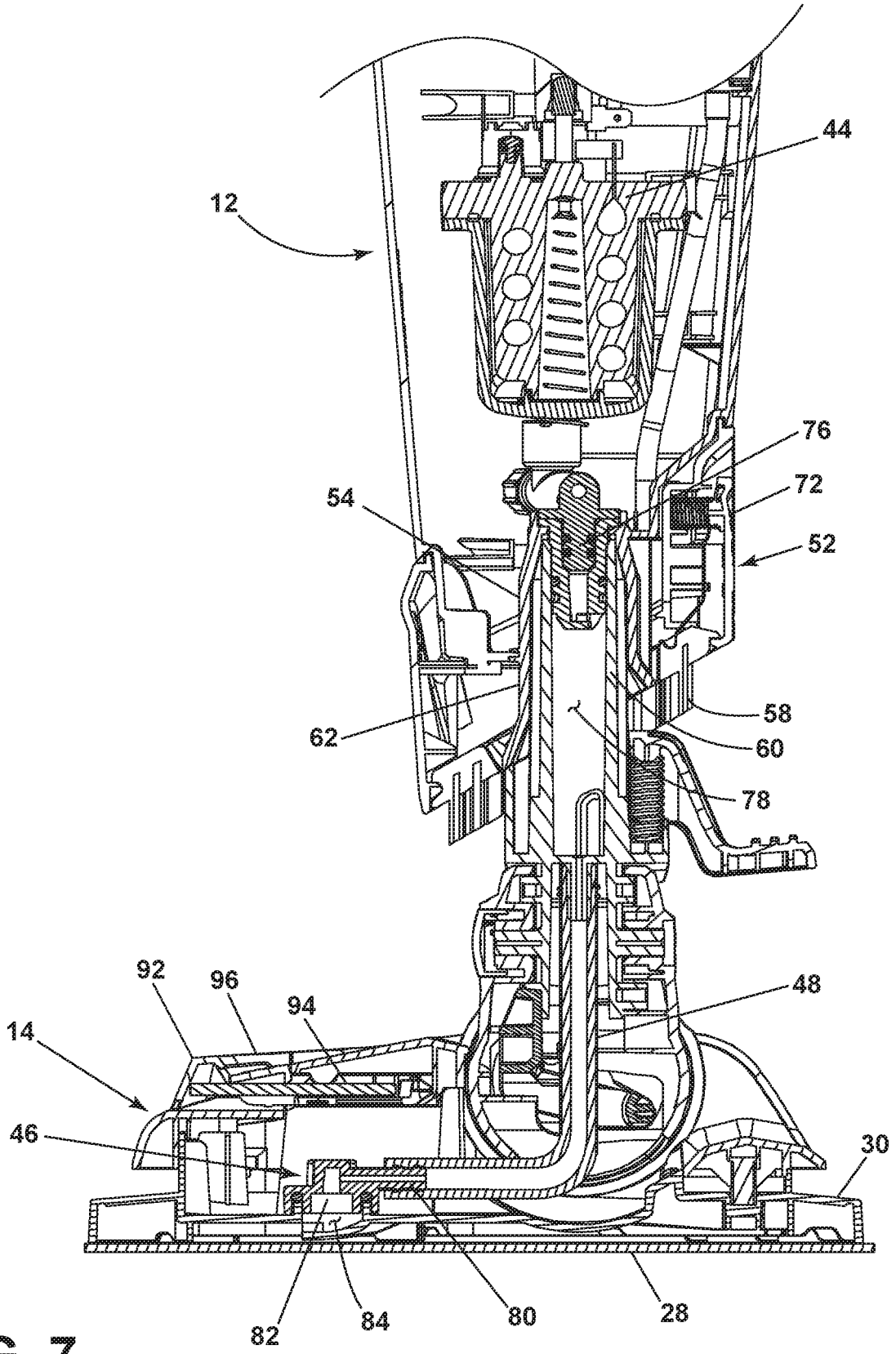
FIG. 7 is a sectional view of the steam mop from FIG. 1 taken through line VII-VII of FIG. 1.

With reference to FIGS. 1, 2 and 7, the fluid distribution system 32 includes a fluid supply tank 40 for receiving and storing a cleaning fluid, which may be liquid such as water. The tank 40 can be removable or non-removable from the mop 10, and can be filled via a fill cap 42. The tank 40 can be fluidly coupled with a steam generator 44 comprising a heating element for heating liquid to at least 100° C. to generate steam. The heating element can comprise a boiler. A distributor 46 can be provided for delivering steam to the surface to be cleaned. In one example, the distributor 46 may be at least one steam outlet or steam nozzle provided in the foot 14. Other examples of the steam distributor 46 may include a manifold having a plurality of steam outlets. The distributor 46 can be positioned to direct steam toward the cleaning pad 28, or directly onto the surface to be cleaned.

The fluid distribution system 32 further includes a steam delivery pathway via which steam is delivered to the surface to be cleaned from the steam generator 44. In the example illustrated herein, the pathway includes at least one conduit 48. The conduit 48 can extend through the coupling joint 26 or outside the coupling joint 26 to provide steam to the distributor 46. As shown in the illustrated example, the conduit 48 comprises a flexible hose extending through the interior of the coupling joint 26. In other examples, the conduit 48 can comprise one or more rigid or flexible conduit sections, or a combination thereof.

A pump 38 can pressurize the distribution system 32 to supply liquid from the tank 40 to the steam generator 44. Other features of the fluid distribution system 32 may optionally include an actuator 34 for the pump 38 to deliver liquid on demand to the steam generator 44 and various conduits and/or valves for controlling the flow of fluid through the fluid distribution system 32. The actuator 34 can comprise a trigger on the grip 22 as illustrated herein, or may be provided in a different form.

A power cord 36, which emerges from the interior of the housing through a cord aperture, can be used to provide power to electrical components of the steam mop 10 from a source of power, such as a home power supply, upon actuation of the actuator 34. Alternatively, the steam mop 10 can be powered by a portable power supply, such as a battery. The operation of the steam mop 10 can be controlled via a mode controller 50 operatively coupled with one or more components of the fluid distribution system 32. For example, the mode controller 50 can be operably coupled with the steam generator 44 and the pump 38 to turn the components on and off, and may further be operably coupled to the pump 38 to select the flow rate of liquid supplied to the steam generator 44, thereby controlling the flow rate of steam delivered to the surface to be cleaned. The mode controller 50 can include a printed circuit board (PCB) operably coupled with a user interface on the exterior of the steam mop 10.

Figure 3:
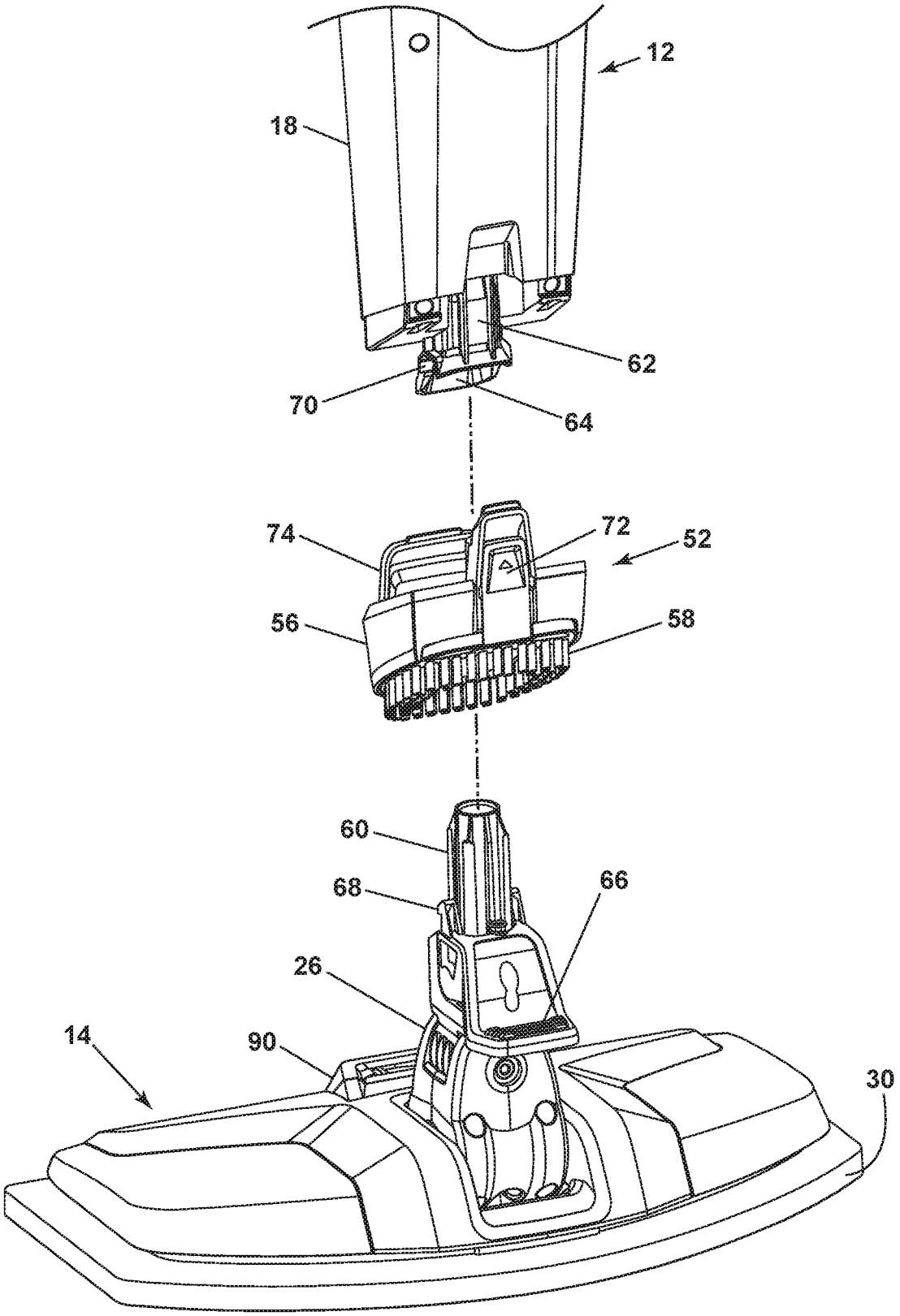
FIG. 3 is a partially exploded rear view of the steam mop from FIG. 1.

FIG. 3 is a partially exploded rear view of the steam mop 10 from FIG. 1. An agitator 52 can be provided on the handle assembly 12 to provide a supplemental cleaning action. The foot 14 is selectively removable from the handle assembly 12 to use the agitator 52.

Figure 4:
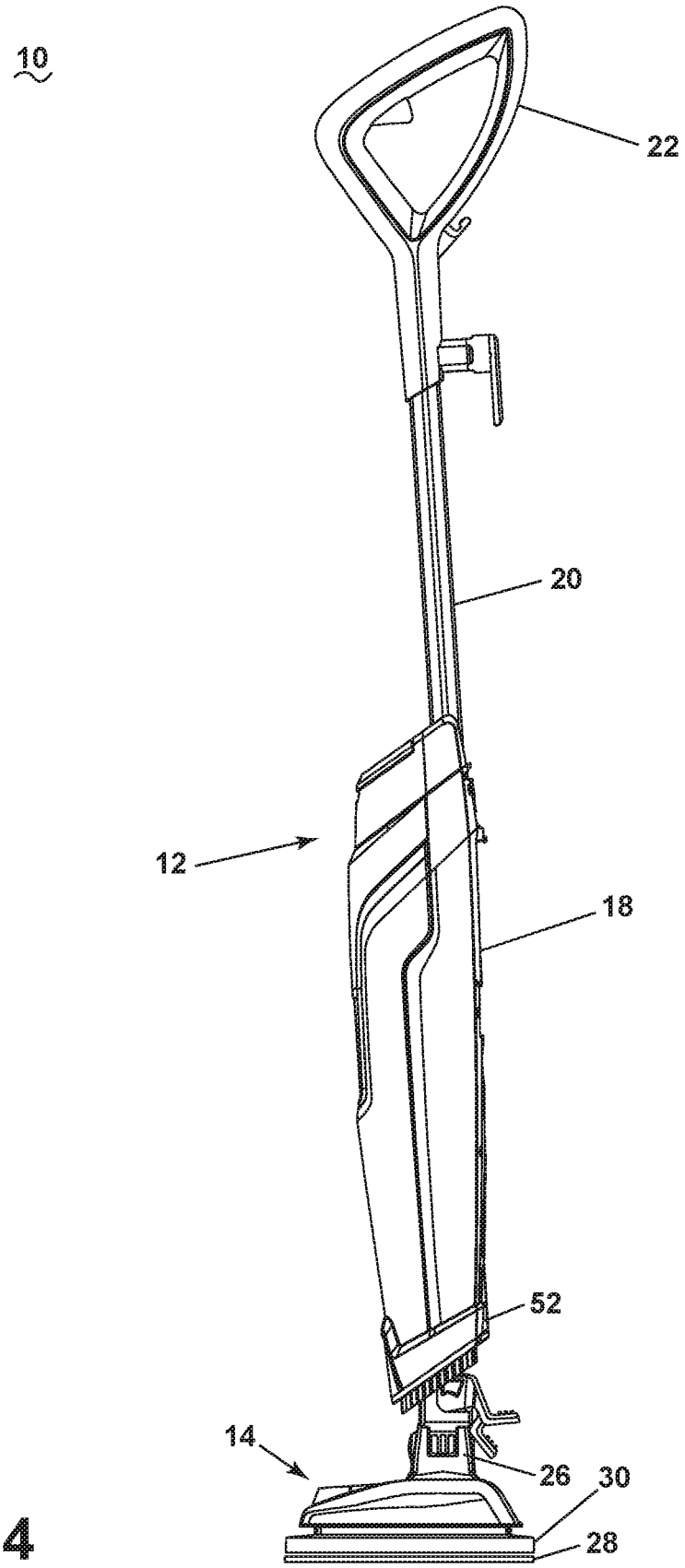
FIG. 4 is a side view of the steam mop from FIG. 1, illustrated in a normal or upright cleaning mode with the foot attached.

FIG. 4 is a side view of the steam mop 10 in a normal or upright cleaning mode with the foot 14 attached to the handle assembly 12. In this cleaning mode, the foot 14 is in cleaning engagement with a surface to be cleaned, and the cleaning pad 28 is wiped across the surface to be cleaned while steam is selectively dispensed via the distributor 46 in the foot 14.

Figure 5:
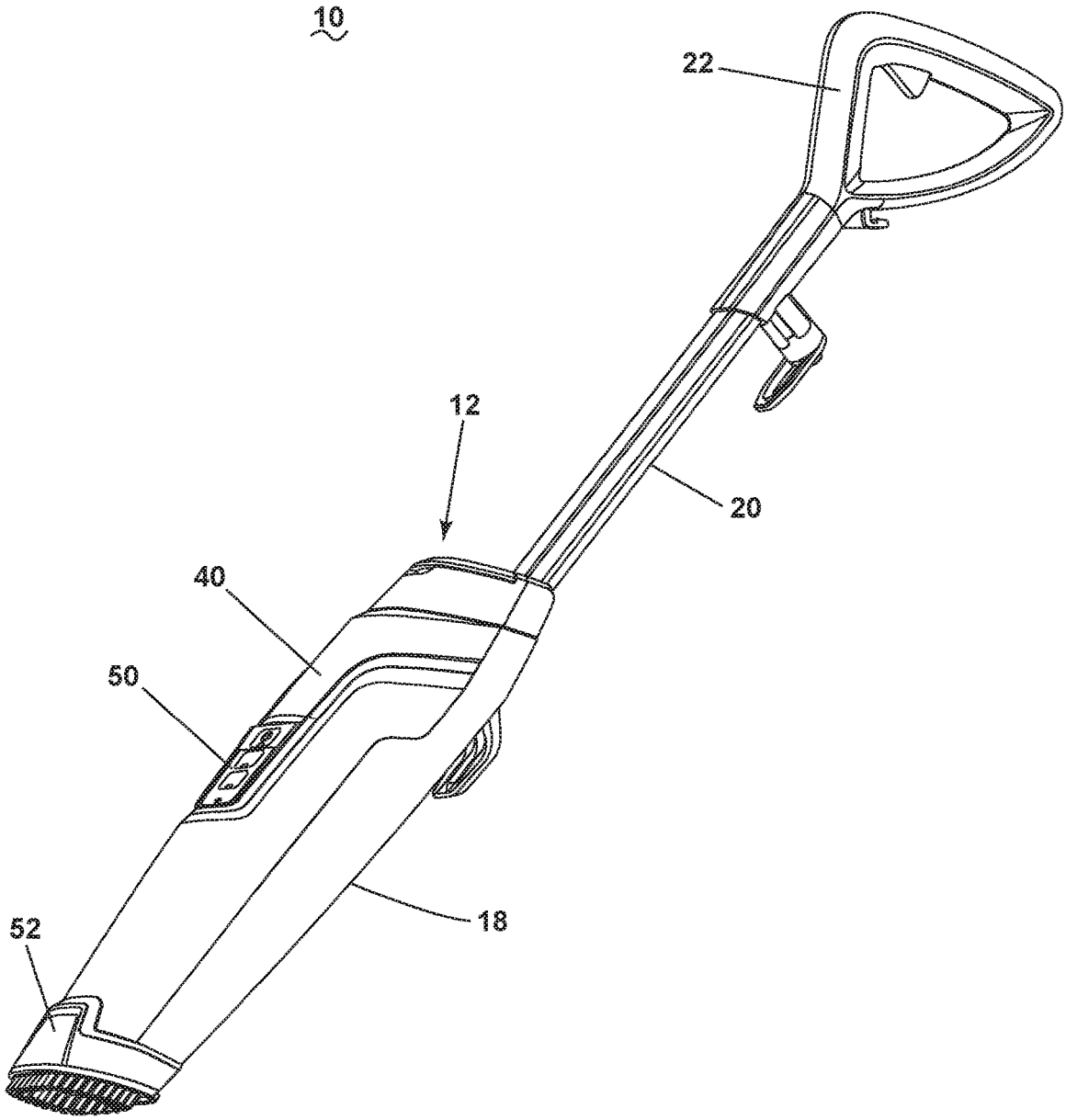
FIG. 5 is a perspective view of the steam mop from FIG. 1, illustrated in a scrub cleaning mode with the foot removed.

FIG. 5 is a perspective view of the steam mop 10 in a scrub cleaning mode, with the foot 14 removed. When the foot 14 is removed, the agitator 52 is exposed at the working end of the apparatus, and in this configuration the steam mop 10 can be used scrub or agitate stuck-on stains and/or debris that are not removed by the cleaning pad 28 in the normal cleaning mode shown in FIGS. 1 and 4. The agitator 52 can have a smaller surface area than the cleaning pad 28, relative to the area of contact with the surface to be cleaned, and so the force exerted by the user using the agitator 52 translates to more pressure being applied to the surface, which may faceplate the removal of stubborn or stuck-on stains. Steam can be selectively distributed onto the surface to be cleaned when the steam mop 10 is used in scrub cleaning mode. In this configuration, steam is distributed through a steam outlet 64 at a lower end of the handle assembly 12 and passes through the center of the agitator 52 onto the surface to be cleaned.

Referring back to FIG. 3, the agitator 52 can be mounted at bottom of the handle assembly 12, around a portion of the steam delivery pathway for steam being delivered to the foot 14. The agitator 52, which may be a scrubber brush having a body 56 supporting a plurality of bristles 58, surrounds a mounting neck or stem 60 of the foot 14, when the foot 14 is mounted to the handle assembly 12. The stem 60 can be hollow to define a portion of the steam delivery pathway therethrough, and is fluidly coupled with the conduit 48. The stem 60 can further be operably coupled with the coupling joint 26 for movement therewith relative to the cleaning head 24.

The handle assembly 12 can include a fluid outlet 54 defined by a fitting 62 on a lower end thereof which receives the stem 60 when the foot 14 is coupled with the handle assembly 12. The fitting 62 can also define a portion of the steam delivery pathway there through, and may define a steam outlet 64 at a lower end thereof that is used to dispense steam in the scrub cleaning mode. The fitting 62 can extend from the housing of the lower handle assembly 18, such that the steam outlet 64 defines a lowermost portion of the lower handle assembly 18.

The foot 14 is selectively removable from the handle assembly 12 via a spring biased release pedal 66 with at least one hook 68 that engages a retainer 70 on the lower handle assembly 18. In the illustrated example, two hooks 68 and two retainers 70 are provided. The retainers 70 are provided on the fitting 62, on opposing sides of the steam outlet 64, but may alternatively be provided on another portion of the lower handle assembly 18.

The agitator is also selectively removable from the handle assembly 12 in the scrub cleaning mode. The agitator 52 includes a spring-biased release latch 72 and can be removed from the handle assembly 12 for cleaning or replacement. A support rib 74 can be provided on the agitator body 56 opposite the release latch 72 to robustly secure the agitator 52 to the handle assembly 12. The support rib 74 and release latch 72 structures are configured to withstand the forward and rearward push and pull forces exerted on the agitator 52 by the handle assembly 12 during scrub mode and thus prevent accidental release of the agitator 52.

Referring to FIG. 7, the agitator 52 can be at least partially hollow to permit a portion of the steam delivery pathway to extend through the agitator 52. When the foot 14 is coupled with the handle assembly 12 in the normal/upright cleaning mode, the steam delivery pathway is defined, in part, by the coupled stem 60 and fitting 62, and extends through the agitator 52. The upper end of the fitting 62 couples with an outlet 76 of the steam generator 44. The stem 60 may be inserted into the fitting 62 such that it surrounds the outlet 76 when the foot 14 is coupled with the handle assembly 12. Thus, the stem 60 can directly couple with the steam generator 44 in the normal cleaning mode with an interior 78 of the stem 60 receiving steam directly from the outlet 76. A seal can be provided at the interface between the stem 60 and the outlet 76 to prevent steam from leaking out of the steam delivery pathway.

A lower portion of the stem 60 is in fluid communication with the conduit 48, with the conduit 48 extends through the coupling joint 26. Thus, the portion of steam delivery pathway above the coupling joint 26, in this case the stem 60 and fitting 62, may be formed of one or more rigid conduits, while the portion of the steam delivery pathway extending through the coupling 26, in this case the conduit 48, may be formed of one or more flexible conduits.

The steam distributor 46 of the illustrated example is a nozzle within the cleaning head that includes a nozzle inlet 80 and a nozzle outlet 82 in fluid communication with the nozzle inlet 80. The conduit 48 can be received on the nozzle inlet 80, and as shown herein the nozzle inlet 80 can project rearwardly to couple with the conduit 48. The nozzle outlet 82 can face downwardly and is aligned with an opening 84 in the pad mounting plate 30 to distribute steam to the back or upper side of the cleaning pad 28. The opening 84 can be provided as a channel through the pad mounting plate 30 that directs steam generally forwardly. A seal can be provided at the interface between the nozzle outlet 82 and the opening 84 to prevent steam from leaking out of the steam delivery pathway.

Figure 6:
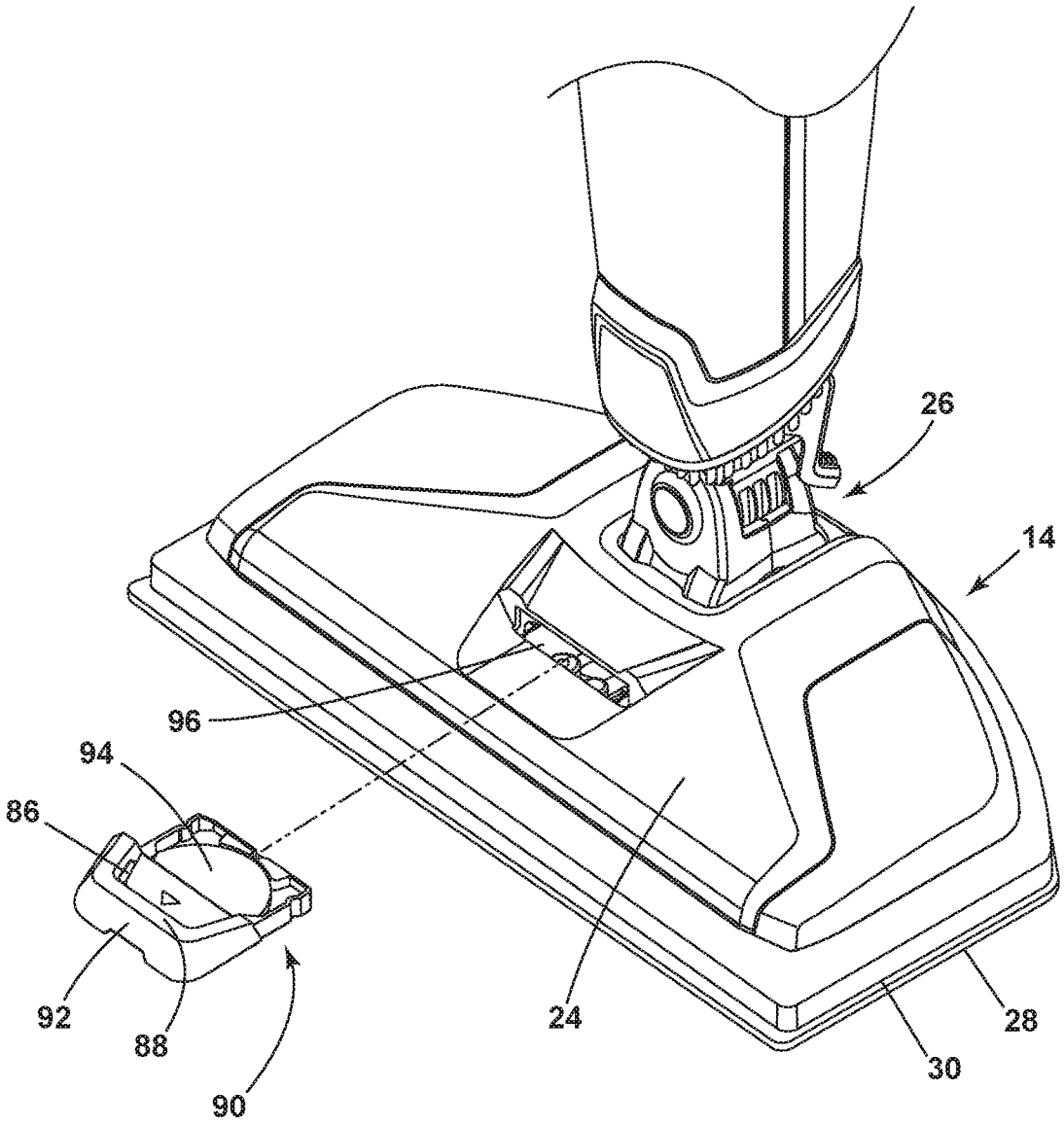
FIG. 6 is a perspective view of the foot of the steam mop from FIG. 1, showing a fragrance dispenser on the foot.

FIG. 6 is a perspective view of the foot 14 of the steam mop 10. The steam mop 10 can be further configured with a fragrance dispenser 90 in order to provide a pleasant sensorial experience while cleaning. The fragrance dispenser 90 includes a warming tray 92 for holding a fragrant material 94, which may be in the form of a disk, or in other suitable forms. The tray 92 is easily accessible from the top of the foot 14, which defines a warming compartment 96 into which the warming tray 92 can slide for receipt of the fragrant disk 94 within the warming compartment 96. The tray 92 and/or compartment 96 may have one or more openings 86 through which fragrance may be released. A user-engageable handle or grip 88 may further be provided on the tray 92 for sliding the tray 92 out of the warming compartment 96.

The warming tray 92 is configured to warm the fragrant material 94 in order to release the fragrance from the disk 94. For example, the warming tray 92 can be adapted to be heated by thermal radiation from steam being supplied through the foot 14, with no direct contact between the steam and the fragrant material 94. A portion of the delivery pathway connected to the steam generator 44 mounted in the handle assembly 12 can pass in proximity to the warming tray 92 and heats the tray 92 by thermal radiation. As shown in FIG. 7, the illustrated example has the steam conduit 48 which couples with the inlet of the steam distributor nozzle 46 passing underneath the warming tray 92 to transfer heat to the tray 92. By limiting the heat transfer between the steam and fragrant material 94 to thermal radiation by indirect contact, the fragrant material 94 is protected from the moisture of the steam, which may shorten the useful lifetime of the fragrant material 94. One or both of the steam conduit 48 and steam distributor nozzle 46 may transfer heat to the warming tray to heat the fragrant material 94.

In the illustrated example, the conduit 48 and distributor 46 are spaced from a bottom wall of the warming tray 92. An open space or cavity in the foot 14 may further separate the warming tray 92 from the conduit 48, creating an air space between the dispenser 90 and conduit 48. Heat from the conduit 48 can be transferred across the air space by a combination of conduction, convection and radiation.

In the illustrated example, the warming tray 92 and fragrant material 94 may be heated to about 80° F.-100° F. in order to release the fragrance from the disk 94. This temperature, however, may vary and depends on various factors such as flow rate through the conduit 48, length of operation of the mop 10, ambient temperature, and other factors.

Heat can accelerate the release and volatilization of an infused fragrance from the disk 94 into the surrounding atmosphere. The infused fragrance can be configured to last for one or more cleaning operations, but will eventually diminish to a negligible level. The user can replace a spent disk 94 with a fresh disk 94 to renew emission of fragrance.

Figure 8:
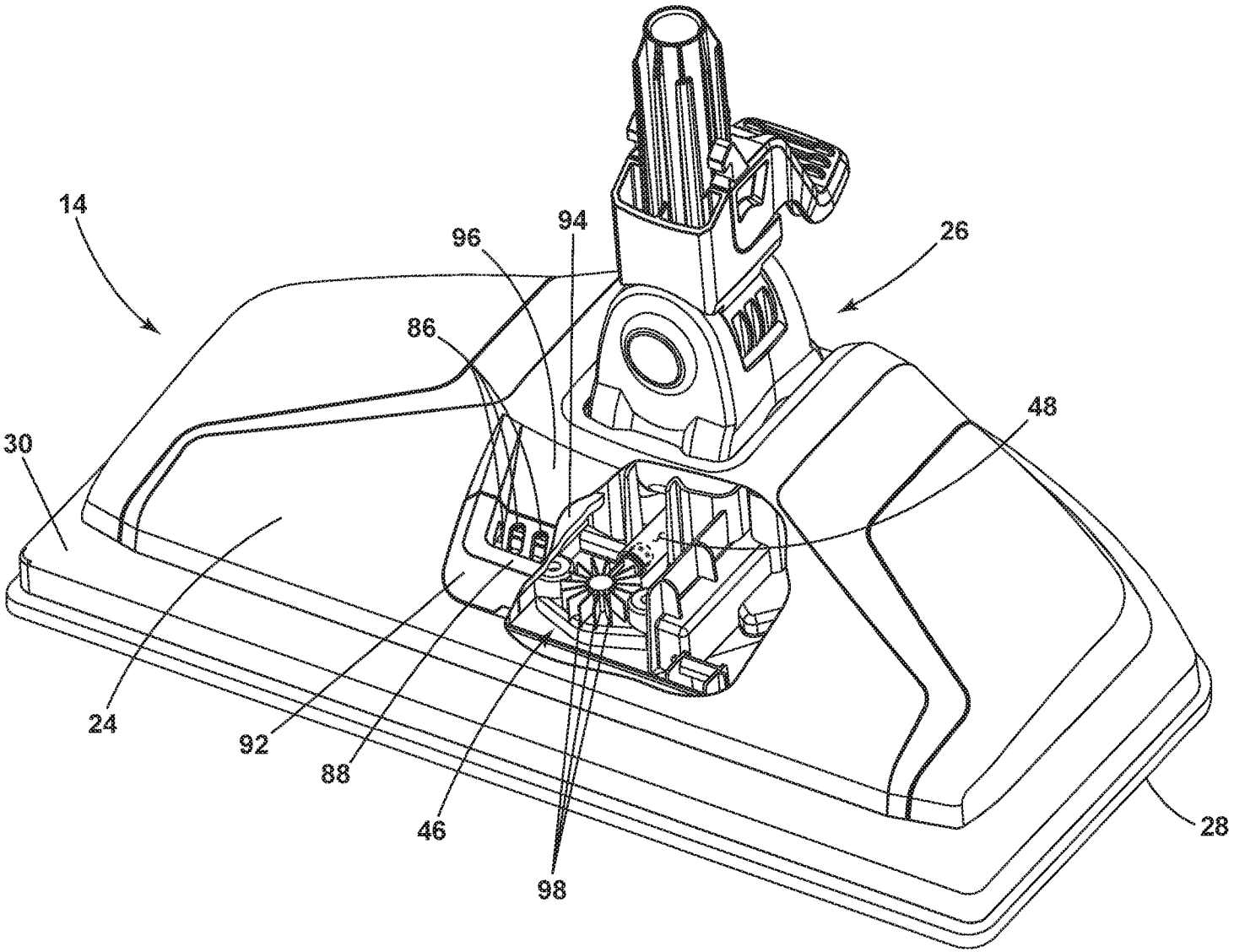
FIG. 8 is a perspective view of another example of a base for the steam mop from FIG. 1.

Some non-limiting examples of a suitable fragrance disk 94 for use with the fragrance dispenser 90 are disclosed in U.S. Pat. No. 8,927,480, incorporated above. For example, FIG. 7 of the '480 patent discloses a fragrance disk in the form of a wafer that is formed of fragrance-infused thermoplastic concentrate such as polyethelyne (PE), polypropylene (PP), or polyvinyl chloride (PVC). FIG. 8 of the '480 patent discloses a wafer that can comprise a porous film formed of a thermoplastic sheet material of PE, PP or polyvinylidene fluoride (PVDF), for example. A plurality of pores are dispersed throughout the film. The wafer can further comprise a coating such as a liquid or gel fragrance, which saturates the pores.

The fragrance dispenser 90 can be accessible to a user from a top side of the foot 14, and may be provided on the upper side of the cleaning head 24. With the cleaning pad 28 provided on a bottom side of the foot 14, opposite from the fragrance dispenser 90, a user can access the fragrance dispenser 90 to load or replace the fragrance disk 94 without having to remove or handle the cleaning pad 28.

Also shown in FIG. 7, the nozzle outlet 82 of the distributor faces away from fragrance dispenser 90, so that steam is directed away from the fragrant disk 94. This may prolong the effective life of fragrances by minimizing their exposure to moisture from steam.

In alternate configurations, the amount of heat transferred from the conduit 48 to the dispenser 90 can be increased. In one example, the length of conduit 48 exposed to the fragrance dispenser 90 can be increased, such as by coiling a portion of the conduit 48 within the warming compartment 96, in proximity to the fragrance dispenser 90.

FIG. 8 is a perspective view of another example of the foot 14, where like elements are referred to by the same reference numerals. The foot 14 of FIG. 8 can be used in place of the foot 14 of the steam mop shown in FIG. 1 In FIG. 8, the amount of heat transferred from the distributor 46 to the dispenser 90 is increased. The steam distributor 46 can include a plurality of radiant heat transfer fins 98 that are configured to increase heat transferred from the steam flowing through the distributor 46 to the fragrance dispenser 90. The heat transfer fins 98 can be provided on a portion of the steam distributor 46 between the nozzle inlet 80 and the nozzle outlet 82. Preferably, the radiant heat transfer fins 98 are provided on the same side of the distributor 46 as the fragrance dispenser 90, and as shown the heat transfer fins 98 can be provided on an upper portion of the distributor 46, below the warming tray 92. The heat transfer fins 98 can extend radially from the upper portion of the distributor 46 or be provided as an array on the distributor 46.

With reference to FIG. 2, the steam mop 10 can include a pressure relief valve 100 in the delivery pathway for relieving backpressure generated by the pump 38 or steam generator 44. In one example, the pressure relieve valve 100 can be provided downstream from the pump 38 and upstream from the steam generator 44, although other locations are possible. A conventional pressure relief valve found in some steam mops includes a spring-loaded plunger plumbed to the fluid delivery path downstream from the pump and upstream from the steam generator to relieve potential backpressure generated by the steam generator or pump when, for example, any portion of the fluid delivery path downstream from the pump, including but not limited to the steam distributor, becomes blocked, clogged or obstructed. The pressure relief valve 100 of the steam mop 10 can comprise an improved and cost-reduced steam pressure relief valve, as described in further detail below.

Figure 9:
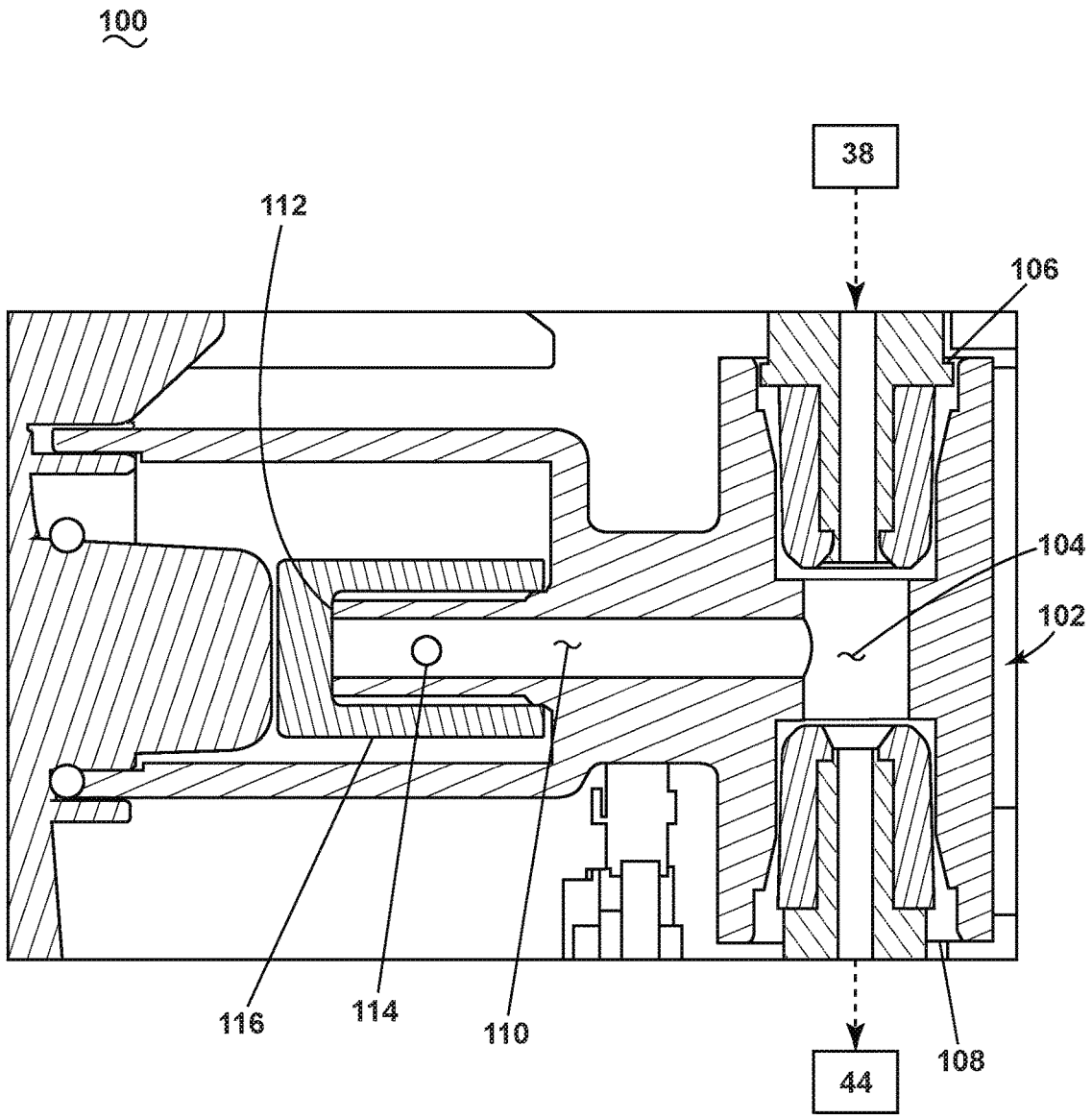
FIG. 9 is a schematic illustration of a pressure relief valve for the steam mop from FIG. 1.

FIG. 9 is a schematic illustration of one example of the pressure relief valve 100 for the steam mop 10. The pressure relief valve 100 comprises a tee 102 in the delivery pathway. The tee 102 can be downstream from the pump 38 and upstream from the steam generator 44, and defines a fluid delivery conduit 104 having an inlet 106 at a first end of the tee 102 in fluid communication with the pump 38 and an outlet 108 at a second end of the tee 102 in fluid communication with the steam generator 44. The third end of the tee 102 forms a pressure relief conduit 110 that extends from the fluid delivery conduit 104, between the inlet and outlet 106, 108. The pressure relief conduit 110 has a free or open terminal end 112 and a vent hole 114 in a sidewall of the conduit 110. A resilient elastomeric sleeve 116 is attached to the pressure relief conduit 110 of the tee 102 to close the terminal end 112 and also to cover the vent hole 114. When pressure inside the fluid delivery conduit 104 reaches or exceeds a predetermined threshold, fluid can be released from the delivery pathway by flowing through the vent hole 114, stretching/deforming the elastomeric sleeve 116 and passing into the housing of the handle assembly 12. Alternatively, the fluid released can be routed to a leak path eventually flowing to the exterior of the housing of the handle assembly 12. The predetermined threshold pressure may be reached or exceed when, for example, any portion of the fluid delivery pathway downstream from the pump 38, including but not limited to the steam distributor 46, becomes blocked, clogged or obstructed.

By being "resilient," the sleeve 116 will elastically deform at the predetermined threshold pressure and will return to its original unstretched and undeformed form when pressure falls below the predetermined threshold pressure. The elastomeric sleeve 116 can be any natural or synthetic rubber that is able to resume its original form when pressure falls below the predetermined threshold pressure. One non-limiting example of an elastomer that is a suitable material for the sleeve 116 includes, but is not limited to silicone rubber having a durometer of about 65 Shore A to 75 Shore A.

One example of the predetermined threshold pressure for the steam mop 10 is 29 PSI. Examples of suitable resilient elastomeric materials for the sleeve 116 that will elastically deform at 29 PSI and return to its unstretched and undeformed state when pressure falls below 29 PSI is NE-Z150 Silicone Molding Resin manufactured by Dongue Silicone (Nanjing) Co Ltd.

The thickness T of the sleeve 116 may also effect its stretchability. In one example, the thickness T of the sleeve 116 for the steam mop 10 is 1.9 to 2.1 mm.

Figure 10:
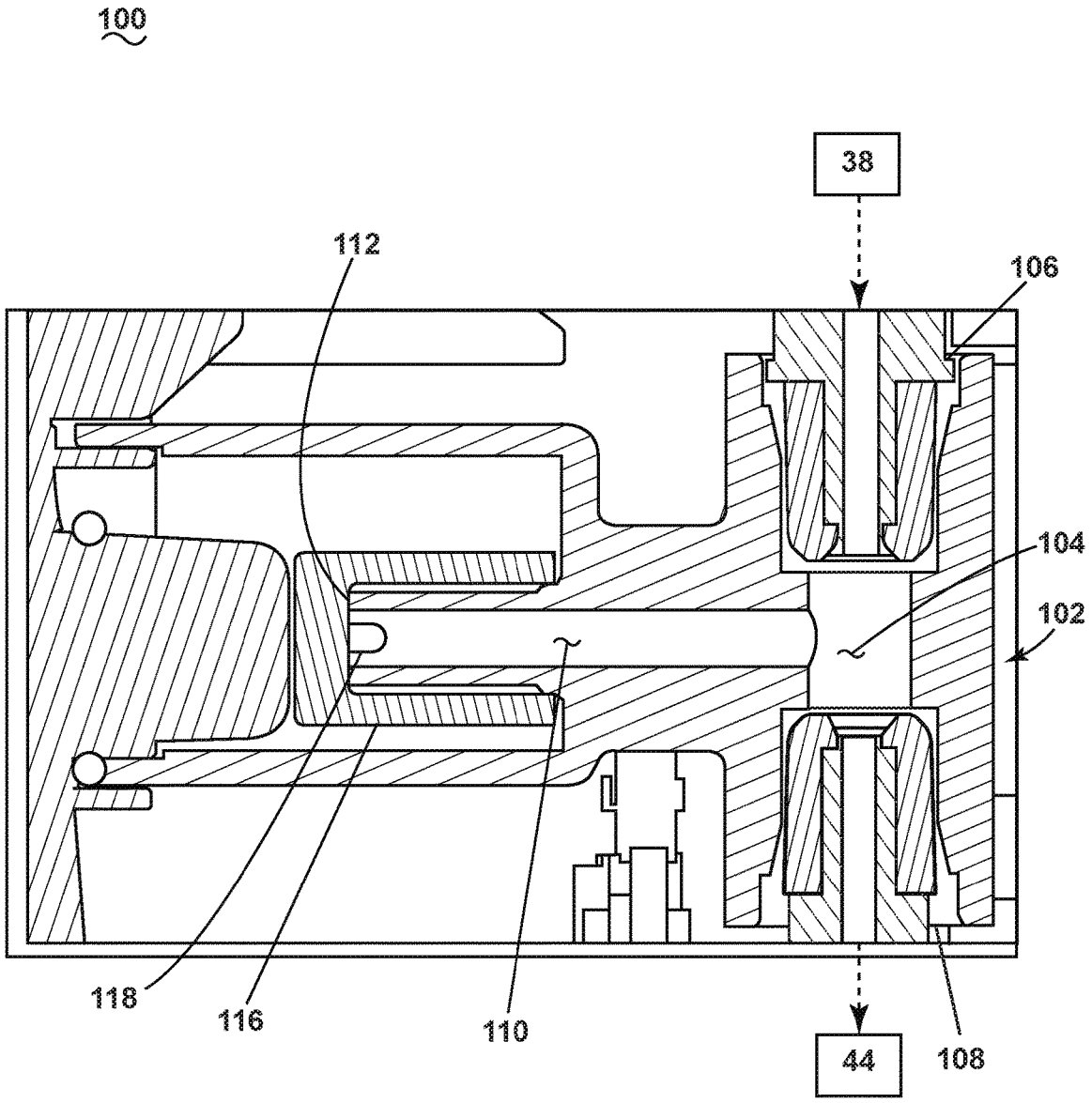
FIG. 10 is a schematic illustration of an alternate pressure relief valve for the steam mop from FIG. 1.

FIG. 10 is a schematic illustration of an alternate example of a pressure relief valve 100 for the steam mop 10. In the alternate example, the vent hole can comprise a slot 118 formed in the terminal end 112 of the tee 102. The function of the slot 118 is substantially similar to the vent hole 114 described previously, but the slot feature improves manufacturability of the tee 102 because the slot 118 can be formed in a less complex injection mold. The slot 118 can be formed in the line of draw, which can eliminate the need for a slide action perpendicular to the line of draw, which would be required to form the vent hole 114 formed inwardly of the terminal end 112 of the tee 102 as shown in FIG. 9. Other than the slot 118, the pressure relief valve 100 of FIG. 10 can be identical to the pressure relief valve 100 of FIG. 9.

There are several advantages of the present disclosure arising from the various features of the apparatuses described herein. The examples of the present disclosure described above provide a fragrance dispenser for dispensing a fragrance from a surface cleaning apparatus. Unlike some prior dispensers that directly contact a fragrant material with steam and dispense a fragranced steam, fragrance is dispensed from surface cleaning apparatus described herein via heat transfer utilizing the steam pathway as a thermal radiation source.

Yet another advantage arising from the various features of the apparatuses described herein is that a surface cleaning apparatus with a scrub cleaning implement and configuration is provided. The provision of a supplemental scrubbing agitator which is accessed by removing the foot having the typical cleaning pad allows a user to scrub or agitate stuck-on stains and/or debris that are not removed by in the normal cleaning mode, while still optionally dispensing steam.

Still another advantage arising from the various features of the apparatuses described herein is that a surface cleaning apparatus can include an improved and cost-reduced pressure relief valve for relieving backpressure generated in the delivery pathway. Unlike some prior pressure relief valves that use a spring-loaded plunger, the examples of the pressure relief valve described herein have a resilient elastomeric sleeve that stretches or deforms based on pressure in the delivery pathway.

Any and all of these advantages can be provided in a surface cleaning apparatus comprising a steam mop, or in other types of surface cleaning apparatus.

To the extent not already described, the different features and structures of the surface cleaning apparatus may be used in combination with each other as desired, or may be used separately. That one surface cleaning apparatus is illustrated herein as having all of these features does not mean that all of these features must be used in combination, but rather is done so here for brevity of description. Furthermore, while the surface cleaning apparatus is shown as being applied to an upright steam mop configuration, features of the surface cleaning apparatus may alternatively be applied to canister-type, handheld, or portable steam cleaners, which share many of the same components as the steam mop. Still further, while the surface cleaning apparatus shown herein includes a steam delivery system which generates steam from liquid and delivers the steam to a surface to be cleaned, in some examples of the present disclosure, not illustrated herein, the surface cleaning apparatus can additionally have a fluid extraction system for creating a partial vacuum to suck up fluid and debris (which may include dirt, dust, soil, hair, and other debris) from a surface to be cleaned and collecting the removed fluid and debris in a space provided on the surface cleaning apparatus for later disposal. Thus, the various features of the different examples may be mixed and matched in various surface cleaning apparatus configurations as desired to form new examples, whether or not the new examples are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a handle assembly;

a steam delivery system, comprising:

a supply tank provided on the handle assembly, the supply tank configured for receiving and storing a cleaning fluid;

a steam generator provided on the handle assembly, the steam generator fluidly coupled with the supply tank and comprising a heating element configured to heat liquid to at least 100° C. to generate steam; and a steam outlet located on the handle assembly;

a base selectively operably coupled with the handle assembly, the base including a steam distributor fluidly coupled with the steam outlet when the base is operably coupled to the handle assembly, the steam distributor adapted for delivering steam to a surface to be cleaned; and an agitator operably coupled with the handle assembly, the agitator located around the steam outlet.

2. The surface cleaning apparatus of claim 1 wherein the agitator is at least partially hollow and steam is delivered from the steam outlet through the at least partially hollow agitator to the surface to be cleaned.

3. The surface cleaning apparatus of claim 1 wherein the agitator is one of moveably coupled to the handle assembly or selectively coupled to the handle assembly.

4. The surface cleaning apparatus of claim 3, further comprising a latch mechanism for retaining the agitator to the handle assembly.

5. The surface cleaning apparatus of claim 1, further comprising a release mechanism configured to disengage at least one retainer on the base from the handle assembly.

6. The surface cleaning apparatus of claim 1 wherein the handle assembly is an upright handle assembly and further comprising a coupling joint operably coupling the upright handle assembly with the base when the base is operably coupled to the upright handle assembly.

7. The surface cleaning apparatus of claim 1, further comprising a cleaning pad attachable to the base.

8. The surface cleaning apparatus of claim 7 wherein the base further comprises a pad mounting plate and the cleaning pad is supported by the pad mounting plate.

9. The surface cleaning apparatus of claim 8 wherein the steam distributor is positioned to direct steam toward the cleaning pad.

10. The surface cleaning apparatus of claim 7 wherein the agitator has a smaller surface area than the cleaning pad.

11. A surface cleaning apparatus, comprising:

a supply tank for receiving and storing a cleaning fluid located on a handle assembly;

a steam generator fluidly coupled with the supply tank and comprising a heating element configured to heat liquid to at least 100° C. to generate steam;

a steam outlet for delivering steam from the handle assembly;

an agitator located adjacent the steam outlet; and a removable cleaning head selectively operably coupled to the handle assembly and forming a foot, the removable cleaning head covering the steam outlet when the removable cleaning head is operably coupled to the handle assembly and wherein the surface cleaning apparatus can be utilized in a first cleaning configuration that is an upright mode with the foot against a surface to be cleaned and wherein removal of the removable cleaning head allows a second cleaning configuration utilizing the agitator against the surface to be cleaned.

12. The surface cleaning apparatus of claim 11, further comprising a cleaning pad attachable to the removable cleaning head.

13. The surface cleaning apparatus of claim 12 wherein the removable cleaning head comprises a pad mounting plate and the cleaning pad is supported by the pad mounting plate.

14. The surface cleaning apparatus of claim 13, further comprising a steam distributor located in the removable cleaning head and fluidly coupled to the steam outlet when the surface cleaning apparatus is in the first cleaning configuration.

15. The surface cleaning apparatus of claim 14 wherein the steam distributor is positioned to direct steam toward the cleaning pad.

16. The surface cleaning apparatus of claim 12 wherein the agitator has a smaller surface area than the cleaning pad.

17. The surface cleaning apparatus of claim 11, further comprising a user-operable mode controller operably coupled with the steam generator and configured to control a flow rate of steam delivered to the surface to be cleaned.

18. The surface cleaning apparatus of claim 11, further comprising a coupling joint operably coupling the handle assembly with the removable cleaning head when the removable cleaning head is operably coupled to the handle assembly.

19. The surface cleaning apparatus of claim 18, further comprising a release mechanism configured to disengage at least one retainer on the removable cleaning head from the handle assembly.

20. A surface cleaning apparatus, comprising:

a handle assembly;

a steam delivery system, comprising:

a supply tank provided on the handle assembly, the supply tank configured for receiving and storing a cleaning fluid;

a steam generator provided on the handle assembly, the steam generator fluidly coupled with the supply tank and comprising a heating element configured to heat liquid to at least 100° C. to generate steam; and a steam outlet located on the handle assembly;

a base selectively operably coupled with the handle assembly, the base including a steam distributor fluidly coupled with the steam outlet when the base is operably coupled to the handle assembly, the steam distributor adapted for delivering steam to the surface to be cleaned; and an agitator operably coupled with the handle assembly, the agitator comprising multiple sides and wherein the multiple sides collectively at least partially surround the steam outlet.

* * * * *